US010399836B2

(12) United States Patent
Landler et al.

(10) Patent No.: US 10,399,836 B2
(45) Date of Patent: Sep. 3, 2019

(54) DEVICE AND METHOD FOR CLOSING FILLED CONTAINERS WITH A SCREW CAP

(71) Applicant: Krones AG, Neutraubling (DE)

(72) Inventors: Bruno Landler, Neutraubling (DE); Markus Schönfelder, Regensburg (DE)

(73) Assignee: Krones AG, Neutraubling (DE)

( * ) Notice: Subject to any disclaimer, the term of this patent is extended or adjusted under 35 U.S.C. 154(b) by 644 days.

(21) Appl. No.: 14/698,775

(22) Filed: Apr. 28, 2015

(65) Prior Publication Data

US 2015/0315002 A1 Nov. 5, 2015

(30) Foreign Application Priority Data

Apr. 28, 2014 (DE) ..... 10 2014 105 907

(51) Int. Cl.

| | |
|---|---|
| ***B65B 61/28*** | (2006.01) |
| ***B67B 3/20*** | (2006.01) |
| ***B67B 1/06*** | (2006.01) |
| ***B67B 7/86*** | (2006.01) |

(52) U.S. Cl.

CPC ..... *B67B 3/206* (2013.01); *B65B 61/28* (2013.01); *B67B 1/06* (2013.01); *B67B 3/20* (2013.01); *B67B 3/2026* (2013.01); *B67B 7/28* (2013.01)

(58) Field of Classification Search

CPC ..... B67B 3/206; B67B 61/28; B67B 3/2026; B67B 3/20; B67B 7/28; B67B 1/06

USPC ..... 53/490, 300, 201, 314, 486, 317, 306, 53/289

See application file for complete search history.

(56) References Cited

U.S. PATENT DOCUMENTS

| | | | | |
|---|---|---|---|---|
| 4,939,890 A * | 7/1990 | Peronek | ..... | B67B 3/2033 53/289 |
| 5,285,618 A * | 2/1994 | Bernhard | ..... | B67B 3/062 53/308 |
| 2012/0017546 A1 | 1/2012 | Peronek | | |

FOREIGN PATENT DOCUMENTS

| | | | | |
|---|---|---|---|---|
| CN | 101878179 | 11/2010 | | |
| CN | 103373682 | 10/2013 | | |
| DE | 10 2007 057 284 A1 | 6/2009 | | |
| DE | 102007057284 A1 * | 6/2009 | ..... | B67B 3/206 |
| DE | 10 2012 103 525 A1 | 10/2013 | | |
| DE | 10 2012 206 944 A1 | 10/2013 | | |
| EP | 1295841 | 3/2003 | | |

OTHER PUBLICATIONS

Search Report from DE Application 10 2014 105 907.7 dated Apr. 22, 2015.

Office Action from related Chinese Application No. 201510202595.3 dated Sep. 27, 2016.

* cited by examiner

*Primary Examiner* — Alexander M Valvis
*Assistant Examiner* — Mary C Hibbert-Copeland
(74) *Attorney, Agent, or Firm* — Haynes and Boone LLP

(57) ABSTRACT

A device for closing a filled container with a screw cap, for example, for closing support ring-less bottles with a screw cap, is described. The device includes a neck guide with at least one torsion protection element for accommodation of a neck section of the filled container in a torsion-protected manner during the closing with the screw cap, and a discharge element for discharging the closed container from the neck guide. The neck guide and the discharge element are displaceable relative to each other.

20 Claims, 4 Drawing Sheets

DEVICE AND METHOD FOR CLOSING FILLED CONTAINERS WITH A SCREW CAP

CROSS REFERENCE TO RELATED APPLICATIONS

This application claims priority from German Patent Application No. DE 10 2014 105 907.7, filed on Apr. 28, 2014 in the German Patent and Trademark Office, the disclosure of which is incorporated herein by reference in its entirety.

BACKGROUND

Technical Field

The present invention relates to a device and a method for closing filled containers with a screw cap, for example, for closing filled containers without support rings with a screw cap in a beverage filling plant.

Related Art

In beverage filling plants, it is known to close containers that have been filled with the applicable fill product by means of a screw cap. The screw cap is lowered by means of a capping head from above onto the container that is to be filled, and at the same time is rotated. The threads of the screw cap thereby contact the threads disposed in the mouth area of the container, and by means of the application of the rotational movement the screw cap is screwed into the closed position.

The screw caps can be provided with so-called warranty bands, which are typically attached to the actual screw caps by thin material bridges, and which are designed such that they are torn off of the actual screw cap, or destroyed, when the screw cap is opened for the first time. In this manner, a consumer can determine whether the beverage container that he acquires is intact, or else has already been opened previously.

In conventional beverage filling plants, screw caps close containers that have a support ring. In order to counteract the torque that is exerted on the container by the screwing-on of the container closure, the support ring is usually retained in a neck guide by means of a spike plate, wherein the spike plate has upwardly directed teeth or spikes that engage the support ring of the container from below in order to counteract the torque of the screw cap.

In conventional beverage filling plants, when the capping process is completed, in order to discharge the containers, which are now provided with screw caps, from the neck guide and convey them to the downstream production steps, the containers are lifted out of the spikes of the neck guides via a transfer rail. The containers with their support rings thereby travel at high speed onto a fixed transfer rail, in order to release the support rings from engagement with the spikes and thereby enable the transfer of the filled and closed containers to a subsequent treatment station, for example via a discharge starwheel.

A new generation of containers has no support ring. These containers are also known as support ring-less bottles. These support ring-less bottles have only a security ring, with which the warranty band of a screw cap can interact such that the warranty band can continue to function.

The known lifting out of the filled and closed bottles by means of a fixed transfer rail can lead to wear or damage to the warranty band, which thereby comes into contact with the transfer rail.

SUMMARY

A device for closing filled containers in a beverage filling plant, which exhibits an improved discharge behavior, is described.

Accordingly, a device for closing a filled container with a screw cap, for example for closing support ring-less bottles with a screw cap, is proposed, including a neck guide with at least one torsion protection element for accommodation of a neck section of the filled container in a torsion-protected manner during the closing with the screw cap, and a discharge element for discharging the closed container from the neck guide. According to the present disclosure, the neck guide and the discharge element are displaceable relative to each other.

Due to the fact that, in addition to the neck guide with the torsion protection element, a discharge element is provided that is displaceable relative to the neck guide, the filled and closed containers can be disengaged from the torsion protection element, and accordingly prepared for discharge, in a gentle manner by the application of a suitable relative displacement between the neck guide and the discharge element. It is accordingly possible to dispense with the less gentle pushing of the filled and closed containers onto a stationary transfer rail, so that the discharge process is improved, including in particular for support ring-less bottles.

In some embodiments, at least two neck guides, which are displaceable along a predetermined movement path such as on a rotary carousel, are provided in the device, wherein each neck guide is associated with its own discharge element. The discharge elements therefore circulate together with the neck guides, so that in this manner each individual filled and closed container can be lifted out of the corresponding torsion protection elements in a gentle and precise manner. Because the neck guide and discharge element circulate together, the only forces that are exerted in this case are those that serve to lift the container out of the torsion protection elements. In this manner, the risk of damage to the warranty band is counteracted, since no forces transverse to the screwing-on direction, which might lead to the destruction of the warranty band, are exerted on the container closure or the warranty band. In this case, the screwing-on direction is generally parallel to a longitudinal axis of the container. The filled and closed containers are, for example, lifted out in a vertical, rather than lateral direction, without the possibility of lateral displacement relative to the torsion protection element taking place.

The neck guides are, in various embodiments, evenly distributed around the circumference of the rotary carousel.

The rotary carousel is, in certain embodiments, continuously driven, or revolves continuously to convey the containers.

The discharge element, in some embodiments, has at least one lifting finger, which is disposed in a capping position below the torsion protection element, and which in a discharge position is disposed at least at the same level as the torsion protection element. By this means the lifting fingers in the capping position of the device can be accommodated in areas of the neck guide such that they come into contact with neither the filled container nor the screw cap that is to be attached, or has already been attached. Only when the container has been fully closed and needs to be prepared for discharge do the lifting fingers of the discharge element come into contact with the closed container. This contact can occur, for example, in the area of the container closure or in the area of the container's warranty band, and thereby enable the lifting of the container out of the torsion protection element.

In one embodiment, the lifting finger in the capping position is disposed in a recess of the neck guide, and, in some embodiments, forms together with the neck guide a substantially continuous surface, in order to enable the screw cap to be screwed on without damage.

The lifting fingers are, in certain embodiments, disposed such that they can carry the container in a fully balanced manner, with the result that when lifted, it is still guided safely, in the position in which it is lifted out of the neck guide, and in particular out of the torsion protection element, and in particular is not tilted. In this manner, it can be achieved that during the lifting-out process and during the subsequent transfer to a downstream processing station, for example by means of a discharge starwheel, the container can continue to be handled safely and gently. Accordingly, in this manner, support ring-less bottles that are provided with screw caps can also firstly be closed safely, and secondly be removed safely from the capper.

In various embodiments, at least two, in some embodiments, at least three, and in other embodiments, at least or exactly four, lifting fingers are disposed on the discharge element. When lifting, the individual lifting fingers engage the container or its closure or its warranty band in differing positions around the circumference of the container. In this manner, the force can be well distributed. In particular, at least two of these positions, and in certain embodiments, all of these positions, are disposed relative to the rotary carousel radially inside the movement trajectory of the containers.

The discharge element and the neck guide are, in some embodiments, disposed such that vertical relative displacement between the neck guide and the discharge element can be carried out in such a manner that the filled and closed container can be disengaged from the torsion protection element in a vertical movement. In this case, it is initially immaterial whether the neck guide together with the torsion protection element is displaced downwards, and the container is thereby held at a constant height on the discharge element, or whether the neck guide with the torsion protection element is held at a constant height and the container is lifted, by means of the discharge element, upwards out of engagement with the torsion protection element. It is also conceivable for simultaneous relative movements, in opposite directions, of the neck guide with the torsion protection element and the discharge element to take place. The applicable relative displacement can be chosen according to the geometric circumstances imposed by the structural and process conditions. The relative lifting displacement between the neck guide and the discharge element is typically calculated in order to raise the filled and closed container reliably out of the torsion protection element, in such a manner that the closed and filled container can then be removed from the neck guide in order to be conveyed to a subsequent treatment stage, for example by means of a discharge starwheel, which for example also takes hold of the container in its neck area.

By means of the vertical relative displacement between the neck guide and the discharge element, the filled and closed container can thus be lifted above the neck guide and the torsion protection elements, such that safe discharge or lateral movement of the container is enabled.

The neck guide is, in certain embodiments, configured such that it can be placed in contact with the container only in the area of the torsion protection elements, and in some embodiments, has a collar that is configured such that it surrounds at least part of the neck section of the container, and on whose upper end surface the torsion protection elements are provided for accommodating a security ring of the container. In other words, the neck guide is, in various embodiments, designed such that only the torsion protection elements are disposed to come into contact with the support ring-less container, for example in the area of the container's security ring. For this purpose, the neck guide, in several embodiments, has a collar that is oriented substantially vertically upwards, and upon whose upper end surface the torsion protection elements are disposed. Accordingly, the filled container rests on the torsion protection elements with its security ring, such that the entire weight of the filled container, together with any force that may be applied by the capping head in order to screw on the screw cap, is thereby borne exclusively by the torsion protection elements. By this means, it can be ensured that the container is retained particularly securely, and the torque applied by the capping head in screwing on the cap can be correspondingly securely counteracted. The collar and the torsion protection elements are, in some embodiments, configured such that they do not come into contact with the screw cap while it is being screwed on. In particular, the warranty band typically overlaps the security ring of the container while the screw cap is being screwed on, or when it has been fully screwed on. Accordingly, the warranty band also overlaps the collar or the torsion protection elements such that lateral displacement of the container that is accommodated in this manner would lead to destruction of the warranty band, since this substantially covers the collar of the neck guide or the torsion protection elements.

The rotary carousel, upon which the neck guide and the discharge element are disposed, in certain embodiments, rotates around a vertically oriented axis of rotation. In other words, the extension of this axis intersects the center of the earth.

The containers are, in various embodiments, transported while hanging freely from the rotary carousel. A railing can also be disposed radially outside the movement trajectory of the containers, by means of which the centrifugal forces acting on the containers can be absorbed.

During the screwing-on process, the torsion protection elements may extend in a plane that is at a greater distance from the center of the earth than the plane that is spanned by the underside of the warranty band.

The lift that is affected by the above-mentioned relative displacement is, in some embodiments, greater than the height of the warranty band.

The discharge element and the neck guide can, in various embodiments, be displaced relative to each other without touching each other, and particularly in some embodiments, the discharge element has a magnet, which by means of a counter-magnet can displace the discharge element from a capping position to a discharge position. This can cause the magnet of the discharge element to travel past a magnetic element that serves as the counter-magnet, in order to enable the discharge element to be lifted. By means of the use of this magnetic drive, contactless operation of the discharge element can be achieved, which is a great advantage from the hygienic point of view.

In addition, the discharge element is, in various embodiments, pre-tensioned relative to the neck guide in a capping position, in which the screw cap can be attached to the container. By this means, it can be ensured that while the screw cap is being screwed on, the discharge element is disposed in the capping position, and accordingly the closing can take place without damage occurring.

A method for closing a support ring-less container with a screw cap is proposed, which includes the accommodation of the support ring-less container on at least one torsion protection element of a neck guide, the closing of the support ring-less container by means of a screw cap, and the displacement relative to the neck guide of a discharge element that is to be brought into engagement with the container in order to lift the closed container from the torsion protection element of the neck guide.

The torsion protection element, in various embodiments, penetrates into an area formed by a warranty band of the screw cap, and comes into contact with a security ring of the container. This area can be substantially a cylinder. This penetration can take place either passively by means of a lowering of the container or the closure, or actively by means of a displacement of the torsion protection element or the neck guide.

In some embodiments, not only is the container lifted as described above by the discharge element, but it is also lowered onto the neck guide by the discharge element when entering the rotary carousel.

BRIEF DESCRIPTION OF THE FIGURES

Further embodiments and aspects of the present invention are more fully explained by the description below of the figures.

DETAILED DESCRIPTION

Examples of embodiments are described below with the aid of the figures. In the figures, elements which are identical or similar, or have identical effects, are designated with identical reference signs, and repeated description of these elements is in part dispensed with in the description below, in order to avoid redundancy.

Figure 1:
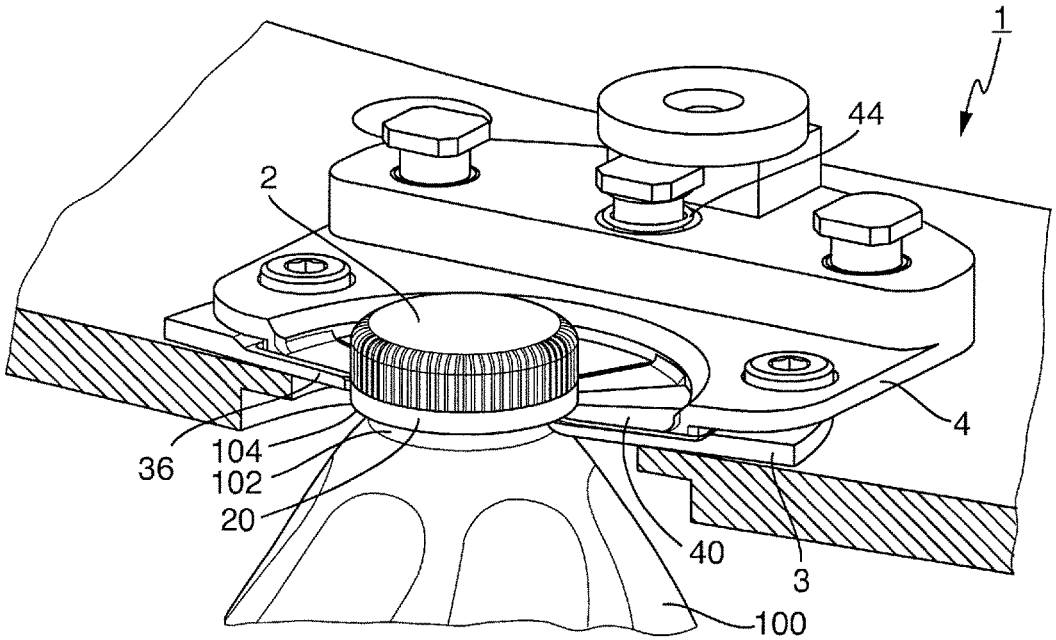
FIG. 1 is a schematic perspective view of a device for closing filled containers in a capping position.
Figure 2:
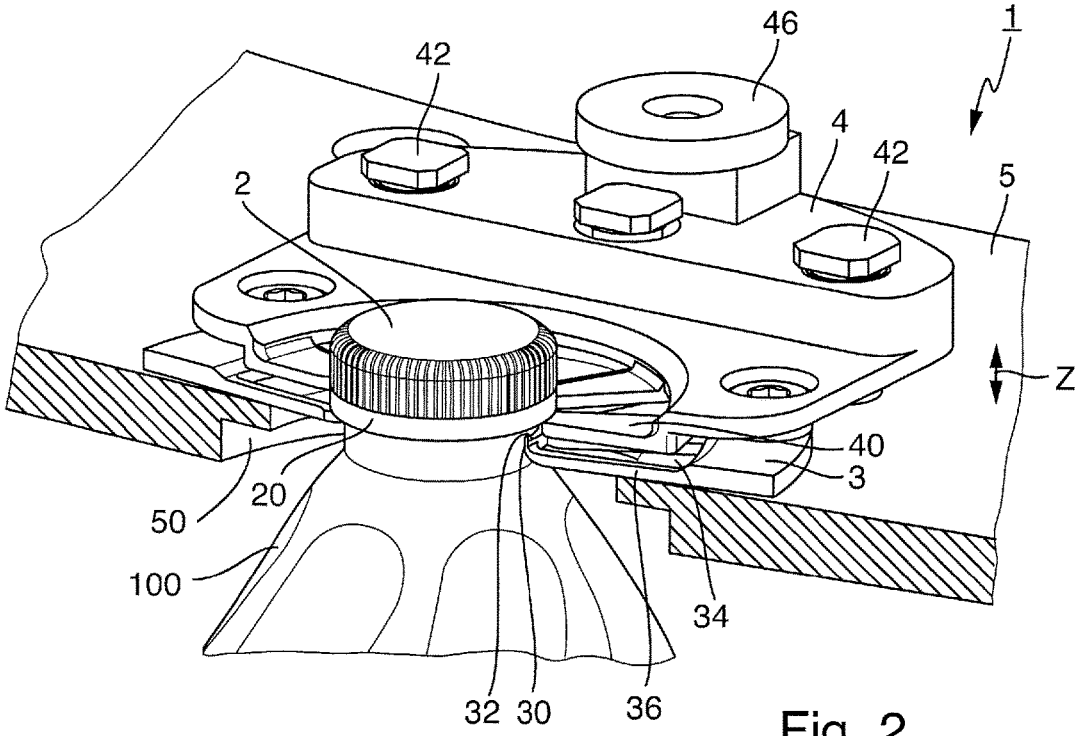
FIG. 2 is a schematic perspective representation of the device shown in FIG. 1 in a discharge position.

In FIGS. 1 and 2, a device 1 for closing filled containers 100 with a screw cap 2 is shown in a schematic perspective representation in two different states. The container 100 is shown in the form of a support ring-less bottle, which accordingly has no support ring on its neck section 102. Instead, only a security ring 104 (which cannot be seen in the figures) is provided, which serves to secure a warranty band 20 of the screw cap 2. The structure of the outside surface of the security ring 104 is such that it can interact with an inner structure of the warranty band 20. The two structures are thereby adapted to each other such that when the container 100 is being closed with the screw cap 2, only a slight resistance is exerted on the warranty band 20, with the result that it is not destroyed when the container 100 is being closed. When the container 100 is opened for the first time, however, the structures cause such a high resistance to be exerted on the warranty band 20 that the warranty band 20 is either destroyed or torn off.

The container 100 is retained in a neck guide 3 of the device 1, wherein the neck guide 3 has a collar 30 oriented upwards that partially surrounds the neck section 102 of the container 100, and upon whose upper end surface a plurality of torsion protection elements 32 in the form of spikes are provided. The collar 30 and the torsion protection elements 32 can be seen particularly clearly in FIG. 2, in which the container 100 is raised in comparison with the position in which it is shown in FIG. 1.

The torsion protection elements 32, which are disposed on the upper side of the collar 30 of the neck guide 3, come into contact with the security ring 104 of the container 100, such that the container 100 rests with its entire weight on the torsion protection elements 32. In other words, the container 100 is retained exclusively by means of the torsion protection elements 32. No other support or retainer exists in the example embodiment that is shown. In particular, no other support surface on which parts of the container 100 would rest is provided.

Because the entire weight of the filled container 100 rests on the torsion protection elements 32, the container 100 can be retained in a manner particularly free from torsion when a torque is applied as the screw cap 2 is being screwed on. The container 100 can thereby be reliably supported against the torque applied to it by a capping head (not shown here) via the screw cap 2 during closing, with the result that no torsion of the container 100 during the capping process takes place, or it takes place only to a negligible extent.

As is shown in FIG. 1, the warranty band 20 of a screwed-on screw cap 2 overlaps the torsion protection elements 32 and at least a part of the collar 30 of the neck guide 3. Accordingly, the warranty band 20 would be damaged if the container 100 in the position shown in FIG. 1 were moved laterally out of the neck guide 3 in order to transfer it to a downstream processing station.

A discharge element 4 is accordingly provided, which has lifting fingers 40 that engage with the screw cap 2. In the example embodiment shown, the lifting fingers 40 also engage with the warranty band 20. As can be seen for example in FIG. 2, the lifting fingers 40 can lift the container 100 together with the screwed-on screw cap 2 vertically upwards out of the neck guide 3, and in particular out of the collar 30 and the torsion protection elements 32. For this purpose, the discharge element 4 is displaceable relative to the neck guide 3, and in particular can be raised in a vertical direction Z upwards with respect to the neck guide 3.

Each of the lifting fingers 40 of the discharge element 4 is flat and smooth in its front area, in which it comes into contact with the container 100 or with the screw cap 2 or the warranty band 20, so that none of the lifting fingers 40 has a structure that impedes lateral discharge. In other words, the container 100 can be displaced on the lifting fingers 40 without the risk of damage to the warranty band 20 or other structures of the filled and closed container 100.

As can be seen in FIGS. 1 and 2, the lifting fingers 40 are accommodated in complementary recesses 34 of the neck guide 3, such that the lifting fingers 40 in the capping position shown in FIG. 1 are disposed below the collar 30 and the torsion protection elements 32. The lifting fingers 40 are thereby also disposed below the warranty band 20 in the fully closed state of the container 100, and particularly, in various embodiments, do not touch the warranty band 20. The position of the discharge element 4 that is shown in FIG.

1 is the so-called capping position, in which the container 100, which rests with its warranty band 104 on the torsion protection elements 32, can be provided with the screw cap 2 in a problem-free manner, without the screw cap 2 or the warranty band 20 striking against the lifting fingers 40 of the discharge element 4. By this means, it is possible when screwing on the screw cap 2 to avoid a collision of the screw cap 2 and the warranty band 20 with the discharge element 4, so that damage to the screw cap 2 or the warranty band 20 can be avoided.

Such gentle handling may be particularly important with support ring-less bottles, since the screw caps used to close them have a very delicate and light construction, and can consequently be damaged easily if not handled correctly.

Because, in the capping position shown in FIG. 1, the lifting fingers 40 of the discharge element 4 are accommodated in the recesses 34 of the neck guide 3, a substantially flat and continuous surface is formed in the example embodiment shown. The collar 30 is retained by corresponding guide fingers 36, which surround the recesses 34.

In the discharge position shown in FIG. 2, the container 100 rests with the warranty band 20 of the screw cap 2, and with its entire weight, on the lifting fingers 40 of the discharge element 4. By means of the vertical displacement of the discharge element 4 relative to the neck guide 3, the container 100 can now be discharged, because it is no longer in engagement with the collar 30 or the torsion protection elements 32, and thus can be displaced laterally without damage to the warranty band 20 or other parts of the filled and closed container 100.

In the example embodiment shown, the discharge element 4 is guided by means of guide bolts 42, along which the discharge element 4 can be lifted or lowered in the vertical direction Z. By means of a pre-tension spring 44, the discharge element 4 is pre-tensioned in the capping position, as shown in FIG. 1, in order to ensure that when the screw cap 2 is being screwed on, damage to the screw cap 2 and the warranty band 20 is avoided.

The lifting or displacement of the discharge element 4 relative to the neck guide 3 is achieved by means of a magnet 46, which, by means of a counter-magnet disposed above the magnet 46 in a discharge area, applies a suitable force in the vertical direction Z to the discharge element 4.

In FIGS. 1 and 2, it can be seen that the neck guide 3 and the discharge element 4 are disposed on the outer radius of a rotary carousel 5, in which a container recess 50 is provided in the area in which the applicable container 100 is to be conveyed.

The discharge element 4 thus circulates together with the neck guide 3. Accordingly, each neck guide 3 is provided with its own discharge element 4, which circulates on the rotary carousel together with the neck guide 3 during the capping process.

The principle of a rotary capper with a rotary carousel 5 is generally known. In particular, above the individual container recesses 50 of the rotary carousel 5, which here define the individual capping stations, capping heads (not shown here) are provided, by means of which the applicable screw caps 2 are screwed onto the filled containers 100 that are disposed in the container recesses 50. By means of the capping heads, the necessary capping torque is applied to each screw cap 2. The capping head can additionally apply a force in the vertical direction to the screw cap 2 and the container 100, such that the screw cap 2 together with the warranty band 20 can be reliably applied and closed. These forces applied by the capping head to the filled container 100 are supported by means of the neck guide 3, so that the container 100 does not rotate in the neck guide 3.

Figure 3:
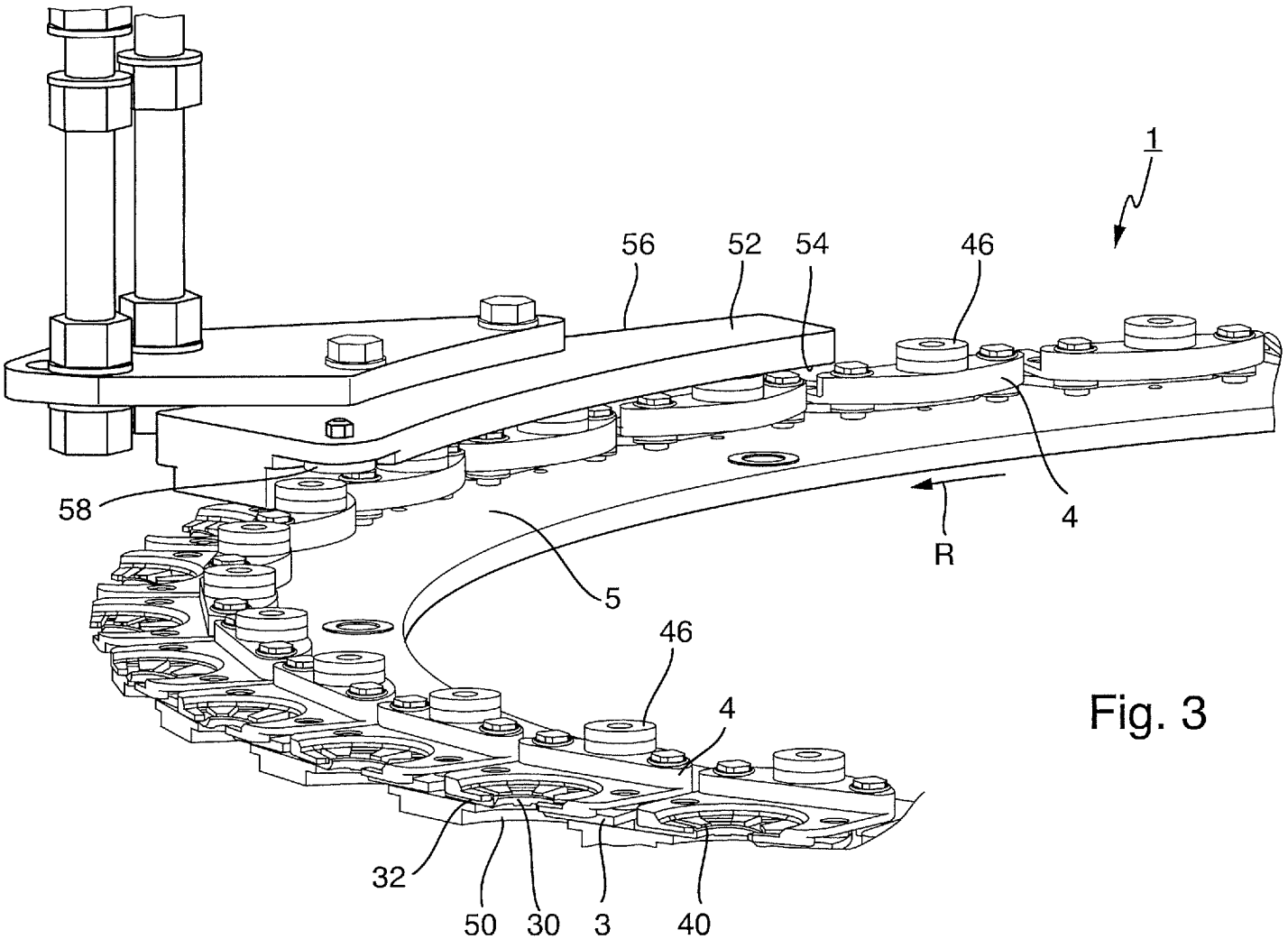
FIG. 3 is a schematic perspective view of a device for closing filled containers with a plurality of neck guides in a rotary carousel.

In FIG. 3, further aspects of a device 1 are shown in a further schematic perspective representation, in which a rotary carousel 5 is again provided, on which a plurality of container recesses 50 are provided, which accordingly define a plurality of capping stations for containers 100. A neck guide 3 and a discharge element 4 are provided at each container recess 50, wherein the neck guide 3 that is used, and the discharge element 4 that is used, are in principle formed as already described in connection with FIGS. 1 and 2. The rotary carousel 5 rotates in a direction of rotation R, which is indicated schematically by an arrow.

A filled and closed container 100 is present in the neck guide 3, as shown for example in FIG. 1. This filled and closed container 100 then reaches a discharge area 52, in which it is to be transferred to a subsequent treatment station. The discharge area 52 is held stationary and the rotary carousel 5 runs past it underneath. Transport can be achieved here, for example, by means of a discharge star-wheel.

In the discharge area 52, the magnet 46 of each discharge element 4 is drawn upwards by means of a counter-magnet 54 disposed above it, so that the discharge element 4 is accordingly displaced from the capping position shown schematically in FIG. 1 to the discharge position shown schematically in FIG. 2.

When this displacement, effected by the magnetic force, of the discharge element 4 from the capping position to the discharge position takes place, the filled and closed container 100 is lifted by means of the discharge element 4, and in particular by means of the lifting fingers 40 from the collar 30 and the torsion protection elements 32 such that it can be discharged laterally in a tangential or radial direction relative to the rotary carousel 5. Because, in the discharge position, the container 100 rests only on the lifting fingers 40, the lateral discharge can be carried out without the risk of damage to the screw cap 2 or its warranty band 20 due to interaction with the neck guide 3.

In the discharge area 52, a discharge contour 56 is provided, which gently guides the containers 100, which rest on the discharge elements 4, tangentially away by their screw caps 2.

When each discharge element 4 has passed through the discharge area 52, the filled and capped container that was previously disposed therein is guided away. At the end of the discharge area, after the area of the counter-magnet 54 has been passed, an oppositely poled corresponding magnet 58 is provided, by means of which the discharge element 4 is actively pushed downwards out of the discharge position into the capping position. In this manner, it is possible to achieve that a newly filled but not yet capped container 100 can be accommodated on the neck guide 3 immediately after the neck guide 3 has passed through the discharge area 52, with the discharge element 4 now again disposed in the capping position that is shown schematically in FIG. 1, and accordingly impeding neither the introduction of the filled container 100 nor the screwing-on of the screw cap 2.

Figure 4:
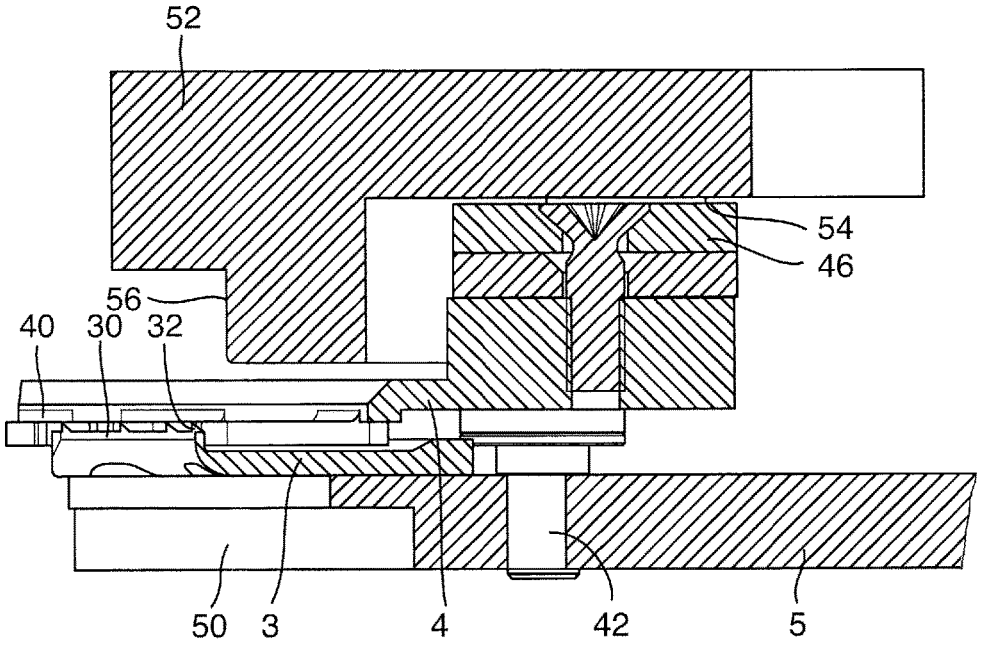
FIG. 4 is a schematic sectional view through a device with a neck guide, a discharge element and a deflecting member in a discharge position.

FIG. 4 shows a schematic sectional view through the rotary carousel 5 in the region of the discharge area 52. The discharge contour 56 can also be seen, as well as the area of the counter-magnet 54, by means of which the magnet 46 of the discharge element 4 is attracted in order to achieve the displacement from the capping position to the discharge position. In the sectional view, the discharge element 4 is accordingly in the raised discharge position. It can be seen that in this manner, the upper surfaces of the lifting fingers 40 are disposed above the collar 30 and the individual torsion protection elements 32. Thus the container with its container closure and the warranty band can pass over these elements, with the result that discharge of the closed container is possible without the destruction of the warranty band.

Figure 5:
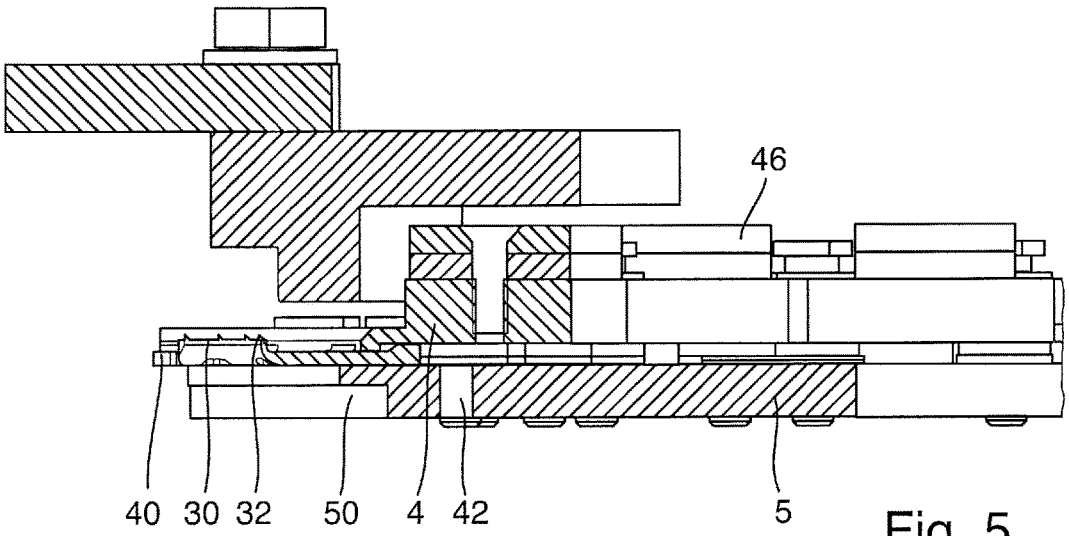
FIG. 5 is a schematic sectional view through a device with a neck guide, a discharge element and a deflecting member in a capping position.

FIG. 5 shows a schematic cross section through the rotary carousel 5 in a state in which the discharge element 4 is disposed in the lowered capping position. Here it can again be seen that the lifting fingers 40 of the discharge element 4 are now disposed below the collar 30 and the individual torsion protection elements 32, with the result that interaction between the discharge element 4 and a screw cap 2 or its warranty band 20 while the screw cap 2 is being screwed on is avoided.

Figure 6:
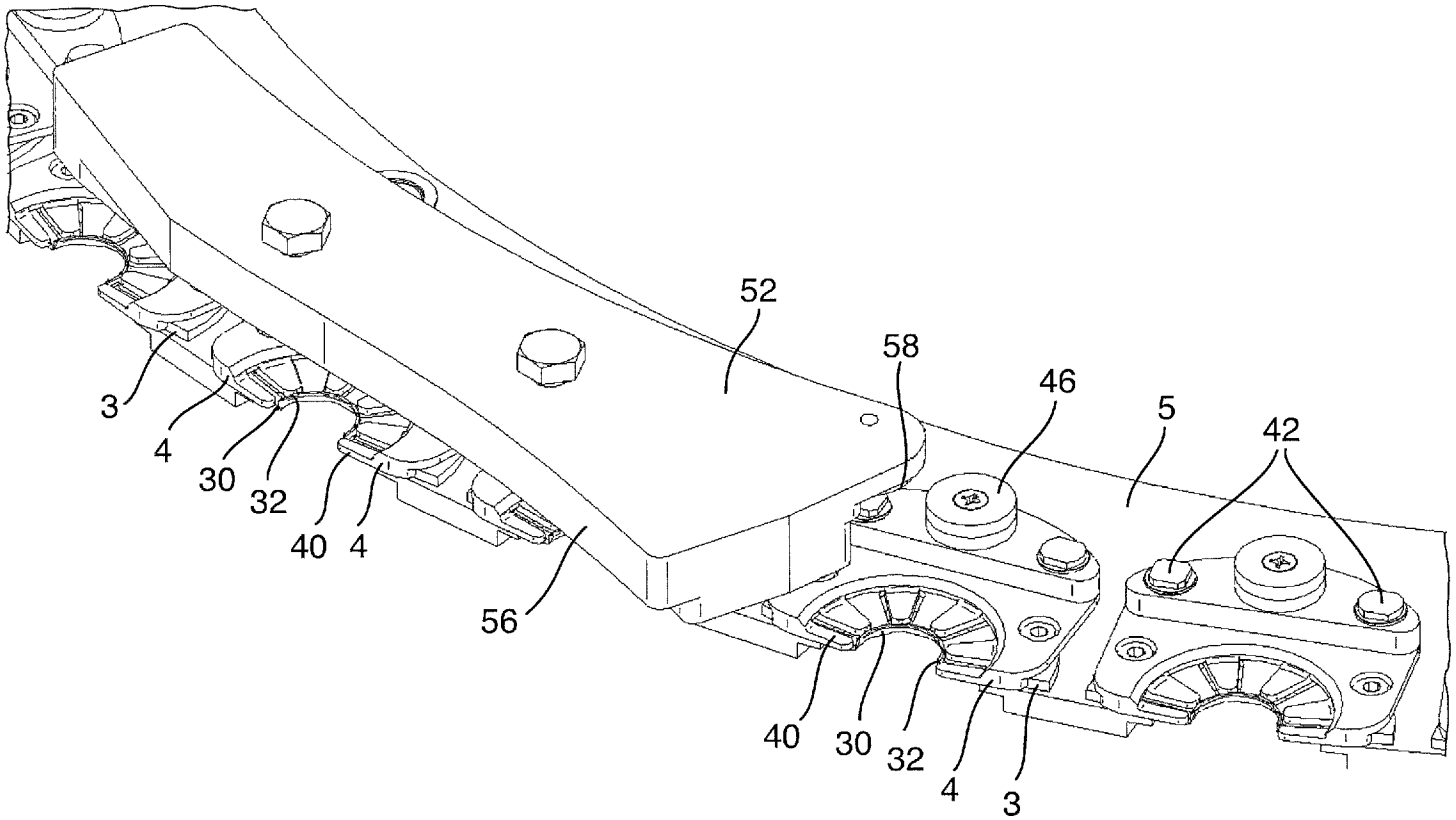
FIG. 6 is a schematic perspective representation of a device for closing filled containers with a plurality of neck guides disposed on a rotary carousel, and with a discharging member.

FIG. 6 again shows in a schematic perspective representation the discharge area 52, which has a corresponding discharge contour 56, at which each container, when raised by the discharge element 4, can be discharged tangentially from the rotary carousel 5.

In place of the magnetic drive by means of the magnet 46 on the discharge element 4 and the corresponding countermagnet 45, which was described in the previous example embodiments, the relative displacement between the discharge element 4 and the neck guide 3 can also be achieved by any other known type of drive. For example, the relative displacement can be applied by the use of a cam roller, which circulates around the rotary carousel 5 in a suitable positive guide. Furthermore, each discharge element 4 can be provided with its own drive, for example a hydraulic or pneumatic lifting cylinder or a servo motor.

Although the device 1 that is described above has been described only in connection with support ring-less containers 100, it can also be used in connection with containers that have a support ring. The neck guide 3 and in particular the torsion protection elements 32 then engage under the support ring. The same applies to the discharge element 4, whose lifting fingers 40 in this case also engage under the support ring.

To the extent applicable, all individual features described in the individual example embodiments can be combined with each other and/or exchanged, without departing from the field of the invention.

The invention claimed is:

1. A device for closing a filled container with a screw cap, comprising:
- a neck guide with at least one torsion protection element configured to accommodate a neck section of the filled container during the closing with the screw cap; and
- a discharge element configured to discharge a closed container from the neck guide, wherein:
- the neck guide and the discharge element are displaceable relative to each other,
- the discharge element comprises at least one lifting finger which is disposed below the at least one torsion protection element in a capping position and is disposed at least at substantially the same level as the at least one torsion protection element in a discharge position,
- the at least one lifting finger is configured to lift the closed container out of the at least one torsion protection element and is disposed in a complementary recess of the neck guide in the capping position, and
- the filled container comprises a bottle having no support ring.

2. The device of claim 1, wherein the neck guide and the discharge element are disposed on a rotary carousel.

3. The device of claim 1, further comprising a guide bolt configured to guide the discharge element in a vertical direction.

4. The device of claim 1, further comprising a second neck guide.

5. The device of claim 4, wherein each neck guide is displaceable along a predetermined movement path and is associated with its own discharge element.

6. The device of claim 1, wherein the at least one lifting finger comprises four lifting fingers.

7. The device of claim 1, wherein the at least one lifting finger forms a substantially continuous surface with the neck guide.

8. The device of claim 1, wherein the discharge element and the neck guide are displaceable relative to each other in a vertical direction.

9. The device of claim 1, wherein the neck guide is configured so that only the at least one torsion protection element is in contact with the filled container in the capping position.

10. The device of claim 9, wherein the neck guide comprises a collar that is configured to surround at least part of a neck section of the filled container.

11. The device of claim 10, wherein the at least one torsion protection element is disposed on an upper end surface of the collar and is configured to accommodate a security ring of the filled container.

12. The device of claim 1, wherein the discharge element and the neck guide are displaceable relative to each other without touching each other.

13. The device of claim 1, wherein the discharge element comprises a magnet.

14. The device of claim 1, wherein the discharge element is pre-tensioned relative to the neck guide in the capping position.

15. A method for closing a container by using the device of claim 1, comprising:
- placing the container on the at least one torsion protection element;
- closing the container with the screw cap;
- engaging the discharge element with the closed container; and
- displacing the discharge element relative to the neck guide to lift the closed container from the at least one torsion protection element.

16. The method of claim 15, wherein the at least one torsion protection element penetrates into an area formed by a warranty band of the screw cap and comes into contact with a security ring of the container.

17. The device of claim 1, wherein the at least one lifting finger is configured to come into contact with the filled container only when the filled container is closed.

18. A device for closing a filled container with a screw cap, comprising:
- a neck guide with at least one torsion protection element configured to accommodate a neck section of the filled container during the closing with the screw cap; and
- a discharge element configured to discharge a closed container from the neck guide, wherein:
- the neck guide and the discharge element are displaceable relative to each other,
- the discharge element comprises a plurality of lifting fingers which are disposed below the at least one torsion protection element in a capping position and are disposed at least at substantially the same level as the at least one torsion protection element in a discharge position, and the plurality of lifting fingers are configured to lift the closed container out of the at least one torsion protection element, and are disposed in complementary recesses of the neck guide in the capping position.

19. The device of claim 18, wherein the plurality of lifting fingers are configured to engage the closed container in differing positions around a circumference of the closed container during lifting.

20. The device of claim 18, wherein the plurality of fingers form a substantially flat and continuous surface in the capping position.

* * * * *